US005249884A

United States Patent [19]

Widmer

[11] Patent Number: 5,249,884

[45] Date of Patent: Oct. 5, 1993

[54] CUSTOM DESIGN INTERLOCKING IN A STANDARD MATRIX

[76] Inventor: Alfred Widmer, 506 Glenway Avenue, Winnipeg, Manitoba, Canada, R2G 1H4

[21] Appl. No.: 755,666

[22] Filed: Sep. 6, 1991

[51] Int. Cl.[5] ..... E01C 5/00

[52] U.S. Cl. ..... 404/42

[58] Field of Search ..... 404/41, 42; 52/311, 52/316

[56] References Cited

U.S. PATENT DOCUMENTS

| | | | |
|---|---|---|---|
| 2,509,558 | 5/1950 | Cadjew | 404/42 X |
| 4,681,481 | 7/1987 | Kapusta | 404/42 X |
| 5,002,425 | 3/1991 | Bordallo | 404/42 |
| 5,054,957 | 10/1991 | Johnson, II | 404/42 X |

FOREIGN PATENT DOCUMENTS

| | | | |
|---|---|---|---|
| 663354 | 8/1938 | Fed. Rep. of Germany | 52/311 |
| 63267 | 4/1949 | Netherlands | 52/311 |

*Primary Examiner*—William P. Neuder
*Attorney, Agent, or Firm*—Bauer & Schaffer

[57] ABSTRACT

Ornamental interlocking inserts are provided, for use with existing structures of interlocking stones, bricks, tiles or the like, or with new structures being built, and a process of providing the inserts is disclosed. The inserts may have a graphic or alphanumeric design, and may be provided with colored portions, to result in a pleasing visual effect.

4 Claims, 4 Drawing Sheets

CUSTOM DESIGN INTERLOCKING IN A STANDARD MATRIX

INTRODUCTORY DESCRIPTION OF THE INVENTION AND PRIOR ART

The use of graphic designs and print on paving-stones, brick facades, or floor or wall tiles of wood, plastic, or ceramic, in the past has been limited either to the edging (trim) or to highly expensive custom work in which the individual pieces are arranged to create a design at a specific job site. The present invention is a highly novel solution to this, allowing an unlimited number of pre-cast graphic or alphanumeric (letter and number) patterns to be available for standard construction and to be placed anywhere in the surface being installed. This can occur because there now exist standard shapes and sizes in building blocks, paving stones, tiles, and the like. The present invention provides for a graphic or alphanumeric design to be pre-cast so that its exterior border conforms to any standard existing pattern or paving stone, or the like.

The invention also permits large designs to be transported safely, without breakage, by manufacture of a large design in segments which inter-fit, with exterior borders that will fit into the standard pattern of building blocks, or paving stones. When a design is to be installed, it may be positioned in the desired place first, and then standard paving stones be laid therearound, in an interlocking manner. As will become clear hereinafter, if it is desired to add ornamentation to an existing driveway, pathway, or other facade, appropriate portions may be removed, in order to insert the pre-cast graphic or alphanumeric design portion, to inter-fit with the existing structure.

A search of the prior art has revealed nothing substantially close to the present invention, and it is proposed that this design concept for pre-producing a one- or multi-piece n-dimensional object whose exterior borders fits into a regular interlocking n-dimensional matrix is novel and possibly useful in contexts beyond the example given of the paving industry. For this reason the reader is advised that the contexts discussed in the introduction and the more detailed description to follow are by example only and in no way are intended to limit the scope of the appended claims.

An object of the invention is to provide ornamental interlocking inserts having exterior border in n-dimensions designed so as to interlock with an n-dimensional regular matrix.

A further object of the invention is to provide ornamental interlocking inserts with at least one dimension thereof having an exterior border in n-dimensions, and comprised of at least two sections, one of said sections having an exterior adapted to abut against the exterior border of a form, said border being adapted to interlock with a matrix made up of regular interlocking n-dimensional pieces, and one or more other sections which will comprise the interior of the form.

A still further object is to provide a process of providing ornamental inserts in paving stones, tiles, bricks, or other facing materials, comprising the steps of:

providing an insert having an exterior border adapted to interlock with a standard pattern or paving stones, tiles, bricks, or other facing materials;

laying said ornamental insert on a prepared bed; and surrounding said insert with interlocking paving stones, tiles, bricks or other facing material.

DETAILED DESCRIPTION OF THE INVENTION

Reference will now be made to the drawings, in which.

Reference will now be made to the accompanying drawings in which like reference numerals will identify like parts.

Figure 1:
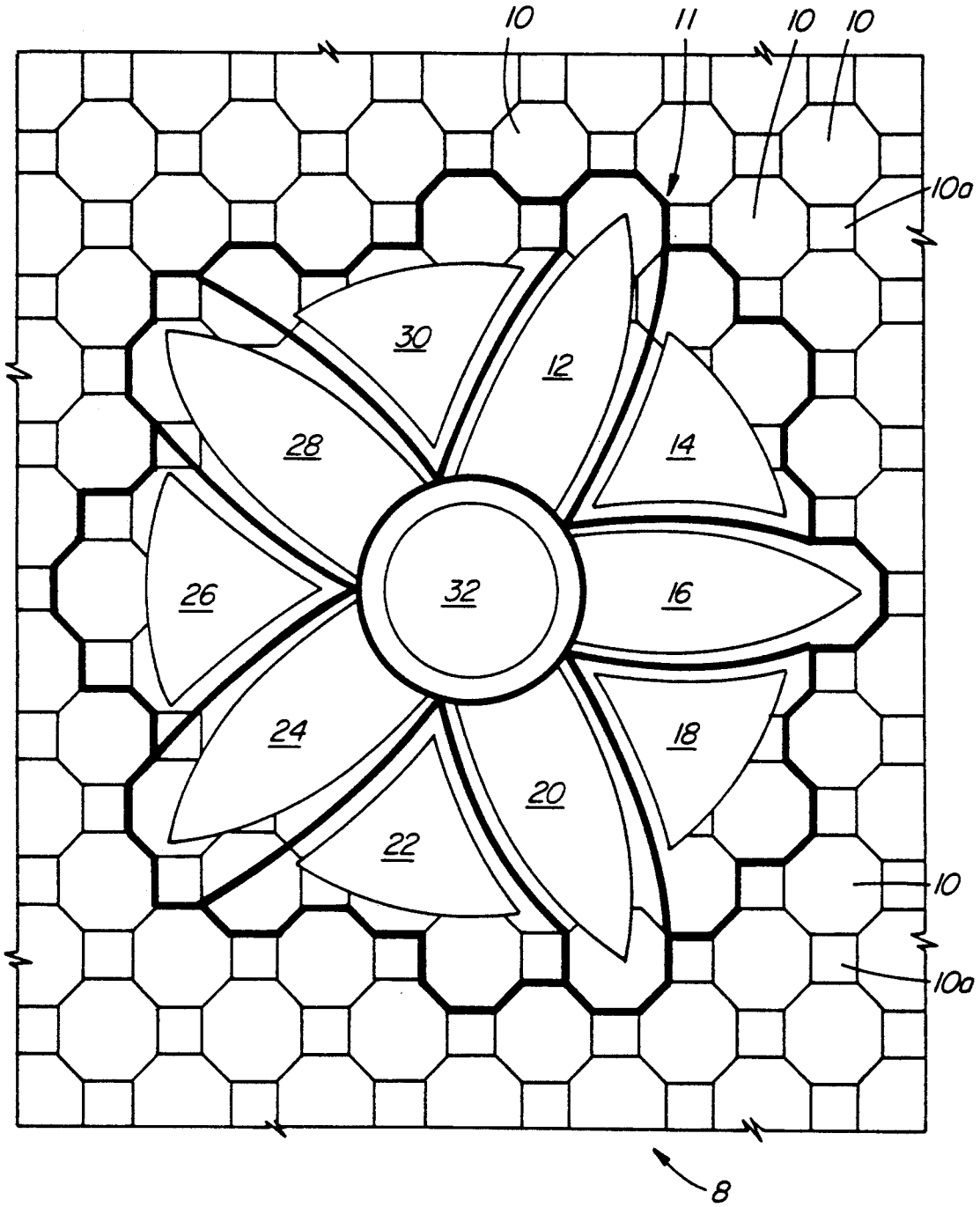
FIG. 1 is a plan view of installed paving stones, with a floral design manufactured according to the invention.

Referring now to FIG. 1, a floral design is illustrated in a driveway, path, or the like, indicated generally at 8. A plurality of interlocking paving stones 10, of octagonal shape, with one square extension 10A are illustrated, and have been installed in a manner known to those skilled in the art. It will be appreciated that paving stones or building stones having other geometrical configurations will find equal utility with the invention.

The heavy lines appearing in FIG. 1 are for purposes of illustration only, and define the segments of the floral design according to the invention, these being petal segments 12, 16, 20, 24, and 28; ornamental rounded triangular segments 14, 18, 22, 26 and 30, and central circular segment 32.

Figure 2:
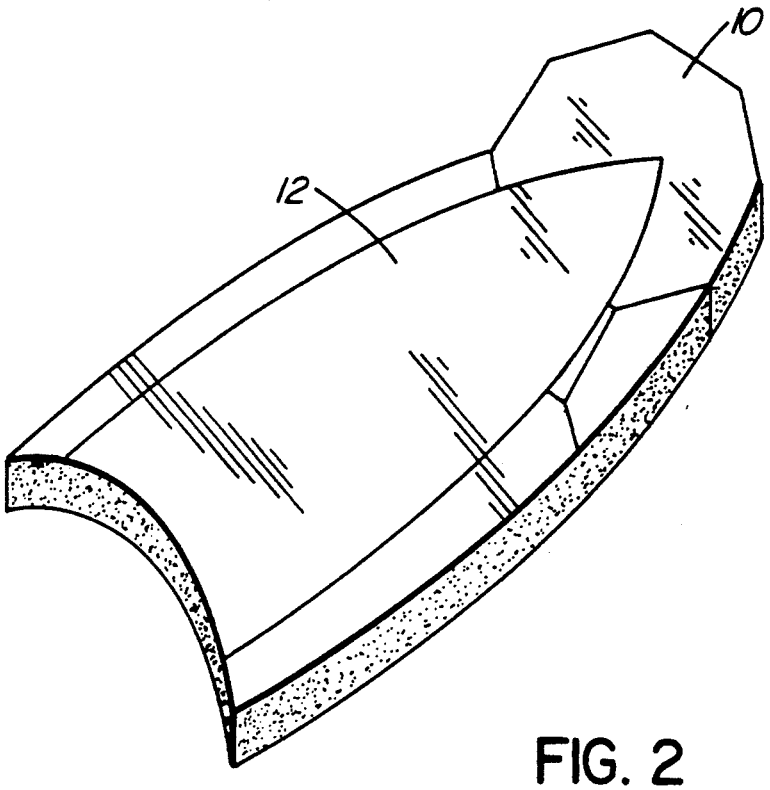
FIG. 2 is a perspective view of a segment of the floral pattern of FIG. 1.

Referring to FIG. 2, petal segment 12 is illustrated in perspective view. The thickness of segment 12 will be equal to the thickness of interlocking paving stones 10, to facilitate construction. It will be seen that the inner end of segment 12 comprises a circular arc, so as to abut circular segment 32 of the floral design. The outer end portion 48 of petal 32 is configured so as to interlock with adjacent interlocking blocks 10, as is indicated at 11 in FIG. 1.

Figure 3:
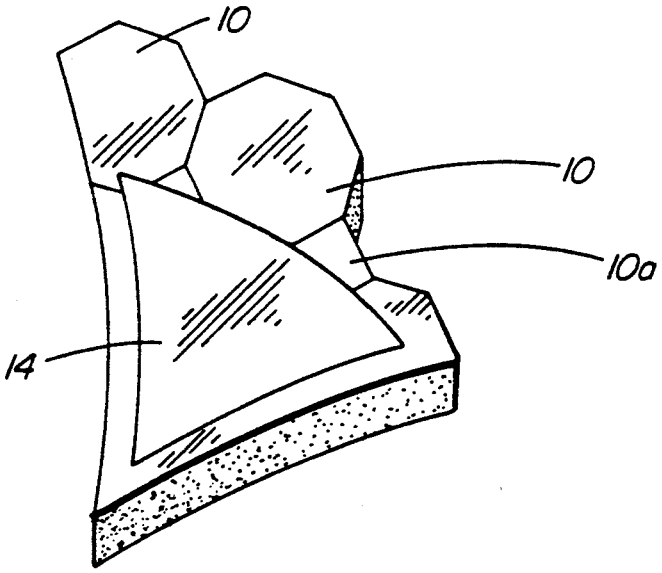
FIG. 3 is a perspective view of a further segment of the floral pattern of FIG. 1.

Similarly, triangular segment 14 of FIG. 3 includes a portion of a pair of paving stones 10, which are molded as unitary extensions of segment 14, so as to interlock with adjacent paving stones 10, in the pathway or driveway. The lines demarking building block portions 10 in FIGS. 2 and 3 may be indented during molding, to simulate the space between adjacent paving stones.

Areas of the ornamental design may be provided with any desired colour, as, for example, red petals 12, yellow central circular segment 32, and so on, so as to provide a pleasing visual effect.

Similarly, portions of the molded design segments may be embossed, filled with material of contrasting appearance or colour, or the like.

Ornamental inserts according to the invention may be added to an existing walkway, pathway or other structure, through the simply expedient of removing a sufficient portion of the existing inter-locking stones or the like, in order to permit the insertion of the ornamental portion, to form a visually unitary part of the existing structure.

Figure 4:
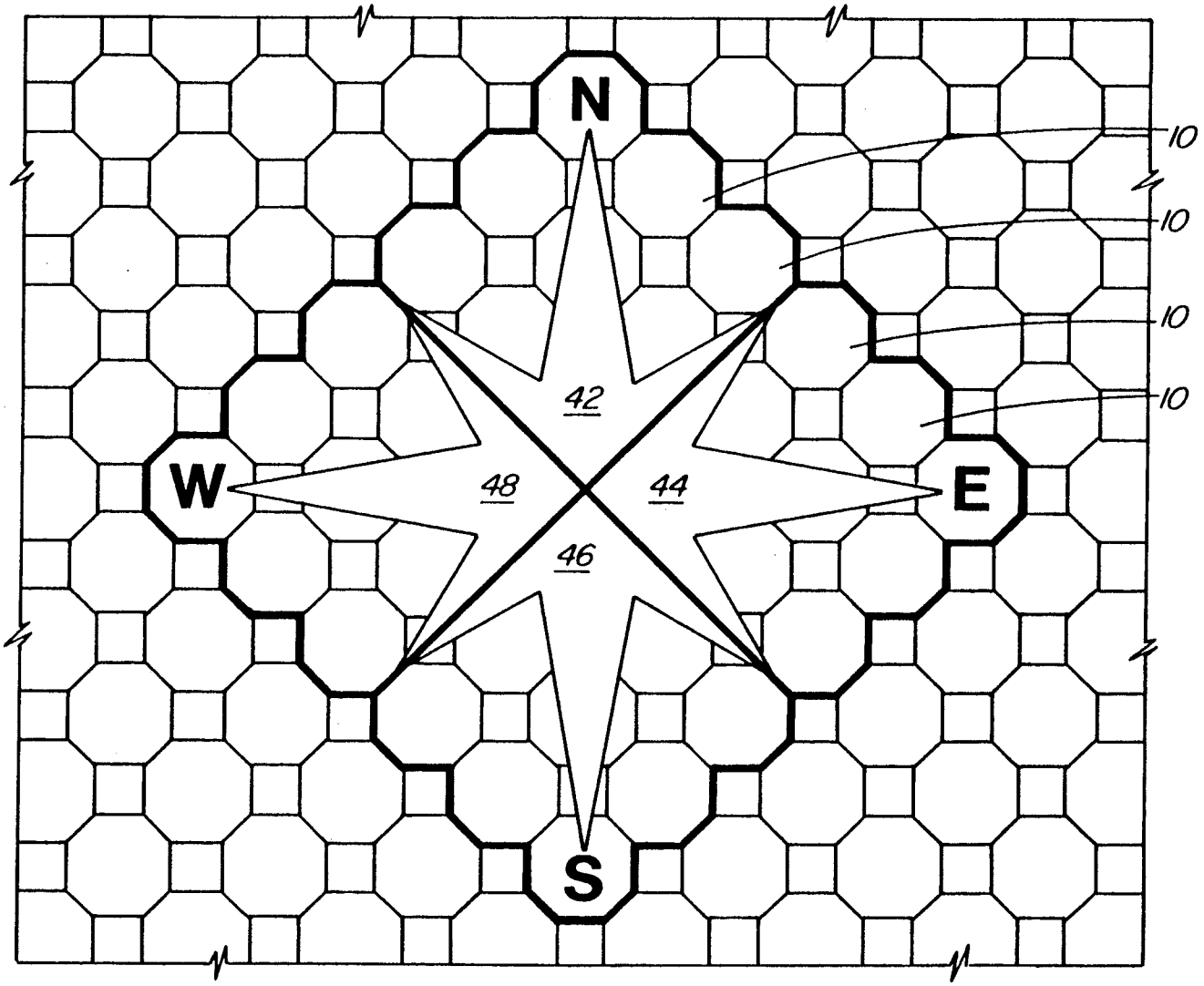
FIG. 4 is a plan view of an installed walkway or the like, having an interlocking compass design.

Referring now to FIG. 4, a compass design has been pre-molded in four segments, 42, 44, 46, and 48. The four portions of the compass design are defined by the heavy lines outlining the design, and bisecting the design in each direction, again, these lines being shown only for purposes of ease of illustration. It will be observed that the exterior of portions 42, 44, 46 and 48 include the representation of interlocking paving stones 10, so as to interconnect with adjacent stones as they are laid around the design, in using normal techniques. In order that a compass design will be oriented so as to indicate the true north, south, east, and west directions, the insert will first be positioned on a prepared bed, to so indicate. Interlocking stones are then placed therearound, as it will be understood by those skilled in the art that it is not necessary for interlocking stones always to run parallel with or at right angles to the edge of a walkway, pathway, or the like.

Figure 5:
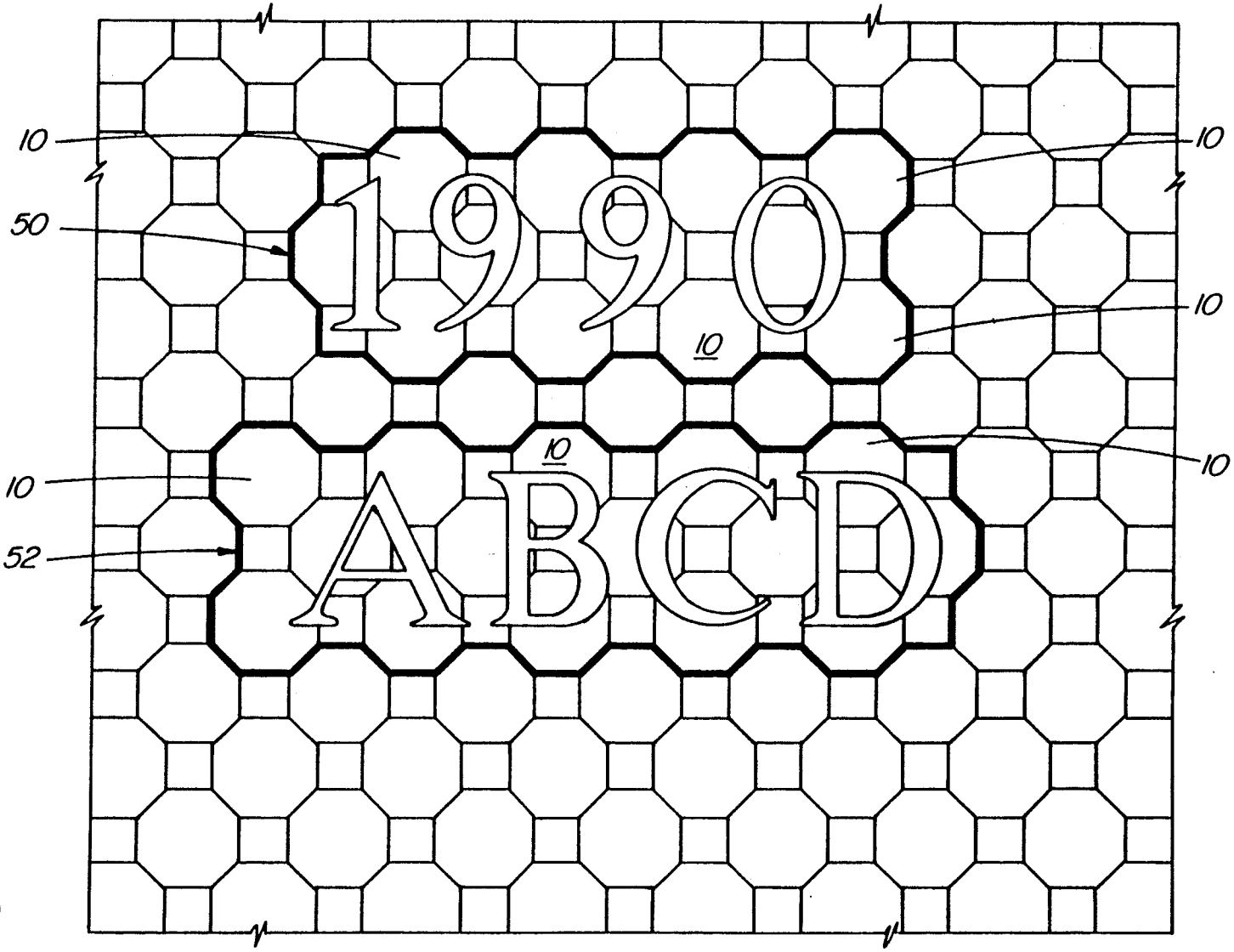
FIG. 5 is a plan view of a walkway or driveway having two alphanumeric stones manufactured according to the invention therein.

FIG. 5 is a plan view of a pair of designs, one comprising numerals, identified by reference numeral 50, the other comprising letters identified by reference numeral 52, again being outlined with heavy line, for purposes of illustration. It will again be observed that these pre-molded ornament segments include the representation of interlocking paving stones 10 on the surface thereof, and that the exterior edges are adapted to be interlocked with paving stones laid therearound.

As an alternative to the employment of ornamental inserts of the same thickness as the adjacent paving stones, portions of the ornamental inserts may be of lesser thickness, say by three or four millimeters, so as to create a visual distinction between the ornamentation and the adjacent paving stones. If desired, sections of the ornamental stones may be of reduced thickness, so as to provide a distinct visual effect. In the example of FIG. 4, the one piece alphanumeric design portions are molded as unitary sections, providing the dimensions are not too great, to make transportation difficult. Is so, again, the design portions may be molded in segments.

The ornamental designs may be used with any other type of regular-pattern matrix. The principle of the invention can be applied to solid (three-dimensioned) shapes which fit into any regular solid matrix, for example molecules; or to any n-dimensional form with a definable exterior fitting into a n-dimensional matrix.

The foregoing is by way of example, and the invention should be limited only by the scope of the accompanying claims.

The embodiments of the invention in which an exclusive property or privilege is claimed are defined as follows:

1. In a covering for a floor, wall, or the like, said covering consisting of a matrix of standard shaped elements from which covering a plurality of adjacent elements has been removed to form an irregularly shaped open area having an interior peripheral border, an insert for placement in said open area, said insert comprising;

a first section comprising an ornamental form having an irregular exterior peripheral border and being set within said irregularly shaped open area and spaced from the interior peripheral border;

a second section set within said open area surrounding said exterior peripheral border of said first section, said second section having a first edge adapted to abut conformingly against the irregular exterior peripheral border of said ornamental form and a second edge adapted to abut conformingly against the interior periphery of said open area, said second section comprising a plurality of separable segments similar in appearance to the standard elements of the covering, some of said separable segments being adapted to abut conformingly against the irregular exterior peripheral border of the ornamental form, some of said segments being adapted to abut conformingly against the interior periphery of the open area, whereby the preformed insert may be placed directly into the open area without the need for cutting of the existing elements of the floor covering, and nevertheless give the appearance of an irregularly shaped ornamental form being placed into the floor.

2. The insert of claim 1 wherein the elements of said matrix comprise tiles, bricks, or other decorative materials.

3. The insert of claim 1 wherein the elements of said matrix comprise substantially identical interlocking elements.

4. The insert of claim 1, wherein the thickness of said insert varies from the thickness of said matrix elements, said matrix being in the form of interlocking paving stones.

* * * * *